US009428255B2

(12) United States Patent
Santa Catarina

(10) Patent No.: US 9,428,255 B2
(45) Date of Patent: Aug. 30, 2016

(54) FLEXIBLE PROPELLER AND USES FOR SMALL VESSELS

(76) Inventor: Mateus Frois Santa Catarina, Rio de Janeiro (BR)

( * ) Notice: Subject to any disclaimer, the term of this patent is extended or adjusted under 35 U.S.C. 154(b) by 737 days.

(21) Appl. No.: 13/994,610

(22) PCT Filed: Dec. 15, 2011

(86) PCT No.: PCT/BR2011/000469
§ 371 (c)(1),
(2), (4) Date: Jun. 14, 2013

(87) PCT Pub. No.: WO2012/079137
PCT Pub. Date: Jun. 21, 2012

(65) Prior Publication Data

US 2013/0272881 A1 Oct. 17, 2013

(30) Foreign Application Priority Data

Dec. 15, 2010 (BR) ..... 1005547

(51) Int. Cl.

| | |
|---|---|
| ***B63H 16/20*** | (2006.01) |
| ***B63H 3/00*** | (2006.01) |
| ***B63H 16/16*** | (2006.01) |
| ***B63H 20/22*** | (2006.01) |
| ***B63H 20/12*** | (2006.01) |
| ***B63H 20/16*** | (2006.01) |
| *B63B 35/79* | (2006.01) |
| *B63H 20/02* | (2006.01) |
| *B63B 35/71* | (2006.01) |

(52) U.S. Cl.
CPC ..... *B63H 3/008* (2013.01); *B63H 16/16* (2013.01); *B63H 20/12* (2013.01); *B63H 20/16* (2013.01); *B63H 20/22* (2013.01); *B63B 35/795* (2013.01); *B63B 2035/715* (2013.01); *B63H 20/02* (2013.01); *B63H 2016/165* (2013.01)

(58) Field of Classification Search
CPC ..... B63H 3/008; B63H 20/12; B63H 20/16; B63H 20/22; B63H 16/16
See application file for complete search history.

(56) References Cited

U.S. PATENT DOCUMENTS

| | | | | | |
|---|---|---|---|---|---|
| 2,873,713 | A * | 2/1959 | Baastrup | B63H 1/32 | 440/20 |
| 4,474,502 | A * | 10/1984 | Daoud | B63H 16/14 | 440/29 |
| 4,960,396 | A * | 10/1990 | Stolzer | B63H 16/12 | 114/153 |
| 5,163,857 | A * | 11/1992 | Hinsley | B63H 1/36 | 440/14 |
| 5,194,024 | A * | 3/1993 | Shiraki | B63H 16/14 | 440/29 |
| 5,316,508 | A * | 5/1994 | Landucci | B63H 16/14 | 114/144 R |
| 5,584,732 | A * | 12/1996 | Owen | B63H 16/12 | 440/13 |
| 8,082,871 | B2 * | 12/2011 | Czarnowski | B63B 7/08 | 114/345 |

* cited by examiner

*Primary Examiner* — Stephen Avila

(57) ABSTRACT

The present invention relates to a flexible propeller that has the feature of generating propulsive force in only one direction, irrespective of the direction of rotation. The flexible propeller may be used in a mechanism similar to a sterndrive, being actuated by two cables and that are wound around a threaded spindle on the sterndrive shaft, one clockwise and the other anticlockwise, and capable of being actuated alternately longitudinally, causing the flexible propeller to rotate in alternate directions, first in one direction and then in the other. The sterndrive in turn may be used in compact structures that can be fitted to catamarans, kayaks or other types of small vessels, without the need for major alterations to the original vessel.

10 Claims, 16 Drawing Sheets

FLEXIBLE PROPELLER AND USES FOR SMALL VESSELS

CROSS-REFERENCE TO RELATED APPLICATIONS

The present application claims the benefits of PCT/BR2011/000469, filed on Dec. 15, 2011, and Brazilians Applications BR No. PI1005547-9, filed on Dec. 15, 2010, and BR No. C11005547-9 filed on Oct. 18, 2011, both of which are entitled "HÉLICE FLEXÍVEL E APLICAçÕES PARA EMBARCAçÕES MIÚDAS" translated here to "FLEXIBLE PROPELLER AND USES FOR SMALL VESSELS", and are incorporated herein by reference in their entireties.

FIELD OF THE INVENTION

The present invention relates to the field of small boats.

SUMMARY OF THE INVENTION

The present invention relates to a flexible propeller 7 that has the characteristic of generating propulsive force in one direction regardless of the direction of rotation.

The flexible propeller 7 can be used in a mechanism similar to a sterndrive, powered by two cables 12 and 13 that are wound around a threaded spindle 14, present on the propeller shaft 8, one clockwise and the other counterclockwise, allowing them to be driven along, alternately, making the flexible propeller 7 rotate alternately, sometimes in one direction, sometimes in another.

The sterndrive may be used in compact structures that allow themselves to be adapted to catamarans, boards, kayaks, boats or other small vessels, without requiring major changes to the original vessel.

The propulsive systems for boats of the current state of the art, for the most part, do not allow themselves to be adapted for surfboards, kayaks, canoes or similar, without the need to pierce the hull to allow the passage of the transmission system, as in the case of U.S. Pat. No. 4,474,502 and U.S. Pat. No. 5,194,024. And the few propulsive systems that can be adapted are inefficient, or complex, such as the U.S. Pat. No. 2,873,713.

BRIEF DESCRIPTION OF THE DRAWINGS

The preferred embodiments of the present invention will now be described, by way of non-limiting examples of the invention, with reference to the attached drawings. In the drawings.

DETAILED DESCRIPTION OF THE INVENTION

Figure 1:
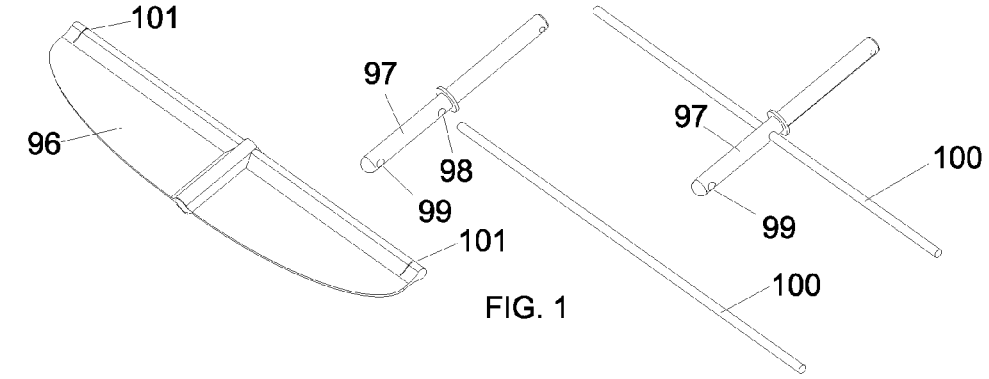
FIG. 1 is made up of figures showing the components of a propeller assembly according to the invention "flexible propeller and uses for small vessels"
Figure 2:
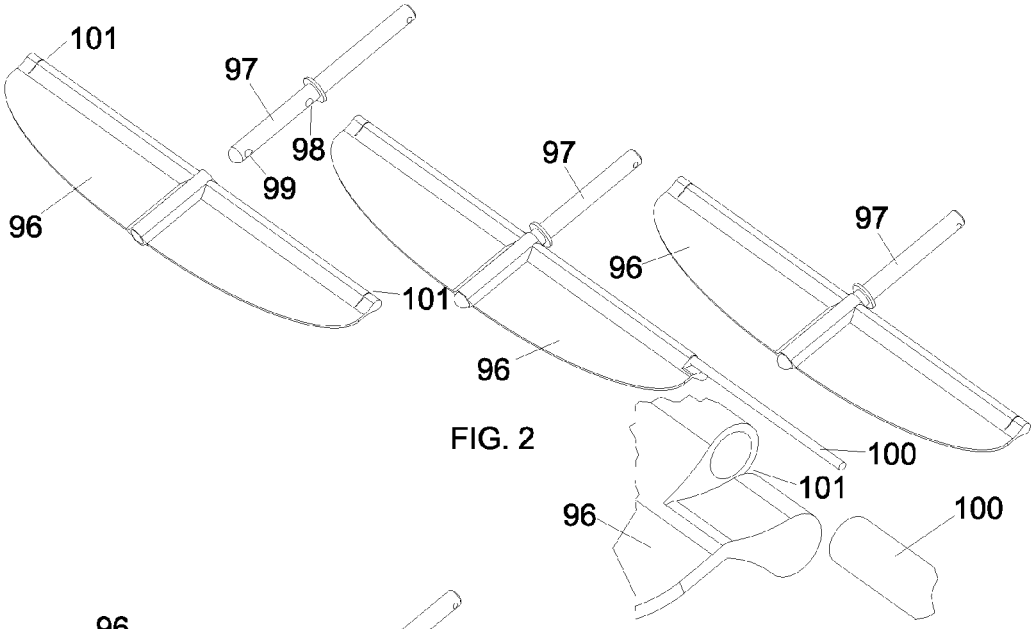
FIG. 2 is made up of figures showing the details of mounting a propeller according to the invention "flexible propeller and uses for small vessels", in a pusher configuration.
Figure 3:
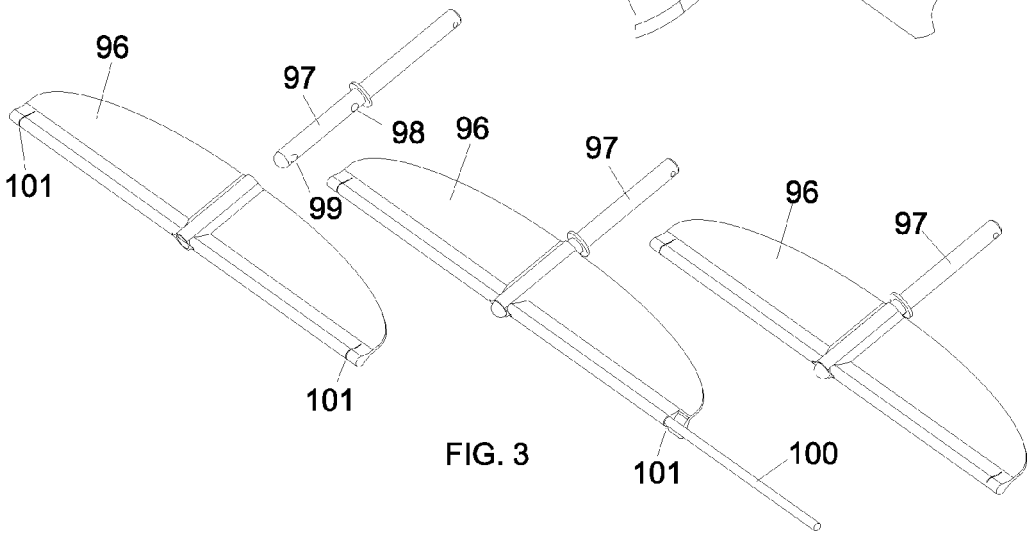
FIG. 3 is made up of figures showing the details of mounting a propeller according to the invention "flexible propeller and uses for small vessels", in a tractor configuration.

FIG. 1 shows a perspective view of the propeller 96 according to the present invention. It is mounted on a rigid shaft 97, which has two holes 98 and 99 to the insertion of a rigid rod 100, which is positioned perpendicular to the shaft 97. The propeller 96 is made from flexible material and has two perpendicular holes in its interior, one hole to accommodate the shaft 97 and the other along the leading edge of the blades, to accommodate the rod 100. The propeller 96 can be mounted on the shaft 97 on the tractor or pusher configuration. FIG. 2 shows the assembly procedure of the propeller 96 in the pusher configuration. First propeller 96 is inserted into the shaft 97. Subsequently, the rod 100 is inserted through the slot 101 present near the blade tip, according sectional detail of FIG. 2, passing into the hole 98 of the shaft 97. Finally the end of the blade is inserted on the rod 100, which is positioned without dropping. FIG. 3 shows the assembly procedure of the propeller 96 in the tractor configuration. First propeller 96 is inserted into the shaft 97. Subsequently, the rod 100 is inserted through the slot 101 present near the tip of the blade passing into the hole 99 of the shaft 97. Finally the end of the blade is inserted on the rod 100, which is positioned without dropping.

Figure 4:
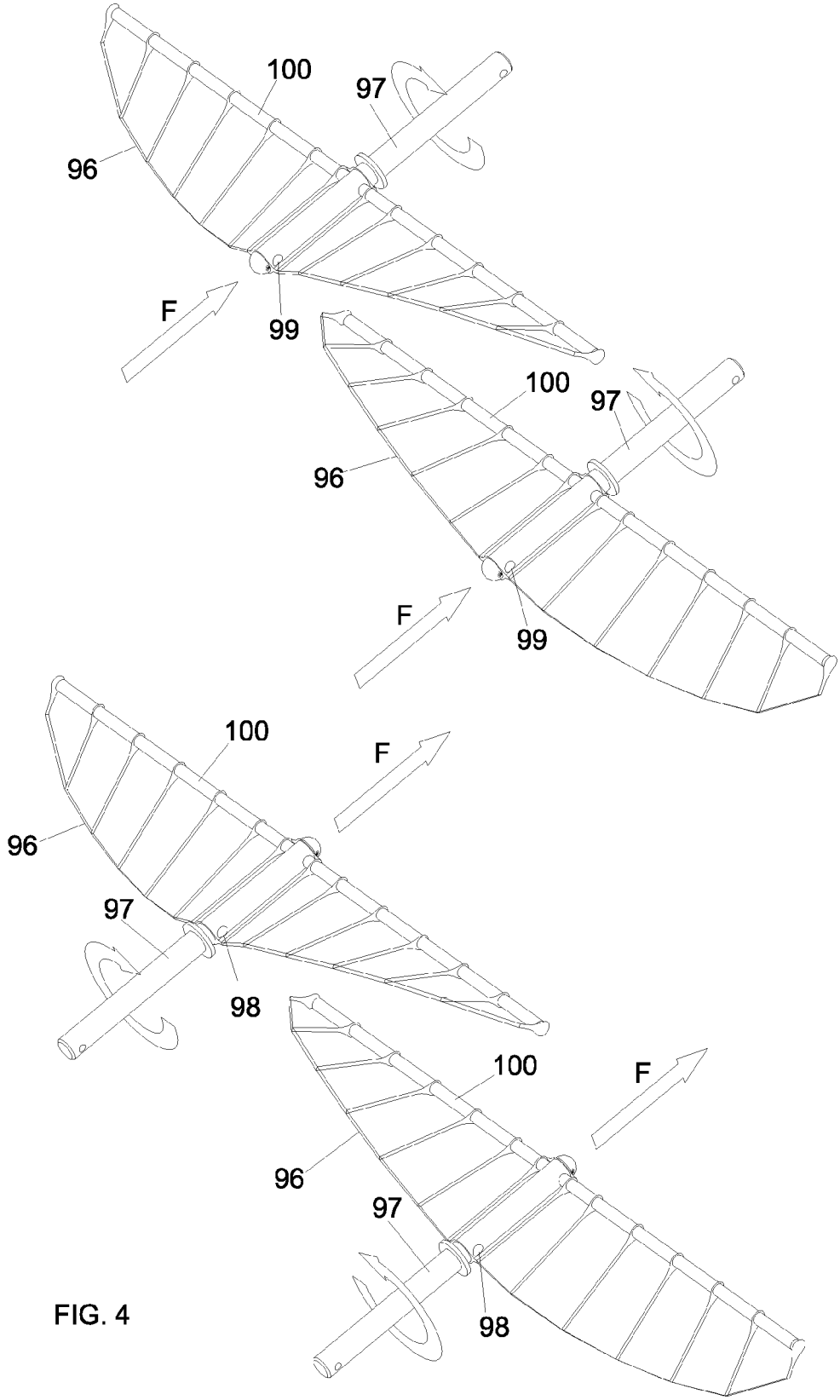
FIG. 4 is made up of figures illustrating the operation of a propeller according to the invention "flexible propeller and uses for small vessels"

FIG. 4 illustrates sections of the propeller 96 blades to facilitate visualization. The first pair of images, located above illustrates the operation of the propeller 96 in the pusher configuration, and the pair located below illustrates the operation in the tractor configuration. As the propeller 96 is made with flexible material and has a rigid rod 100, positioned along the leading edge, as it rotates in one direction, the water exerts a pressure, which center of pressure Cp is located behind the leading edge, deflecting the blades as shown in FIG. 4 and generating a propulsive force F. Turning in the opposite direction, the propeller 96 also generates a propulsive force F in the same direction.

Figure 5:
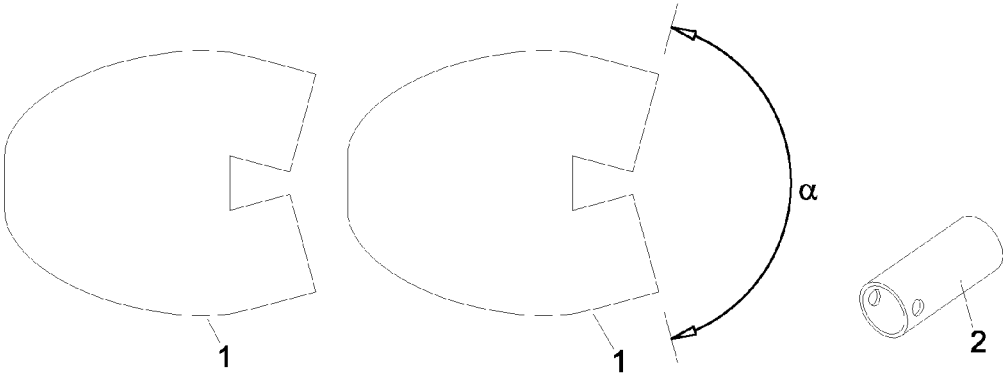
FIG. 5 is made up of figures that shows the items required to fabricate a flexible a propeller according to the invention "flexible propeller and uses for small vessels"
Figure 6:
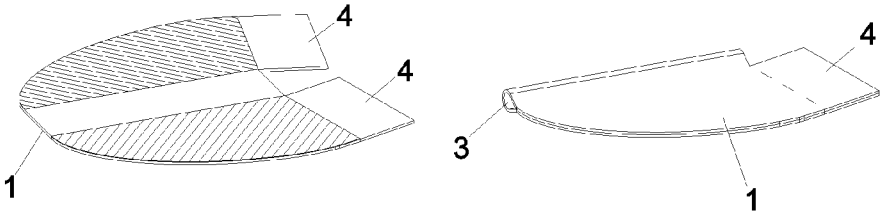
FIG. 6 is made up of figures showing the details of the fabrication of a flexible blade of a propeller according to the invention "flexible propeller and uses for small vessels"
Figure 7:
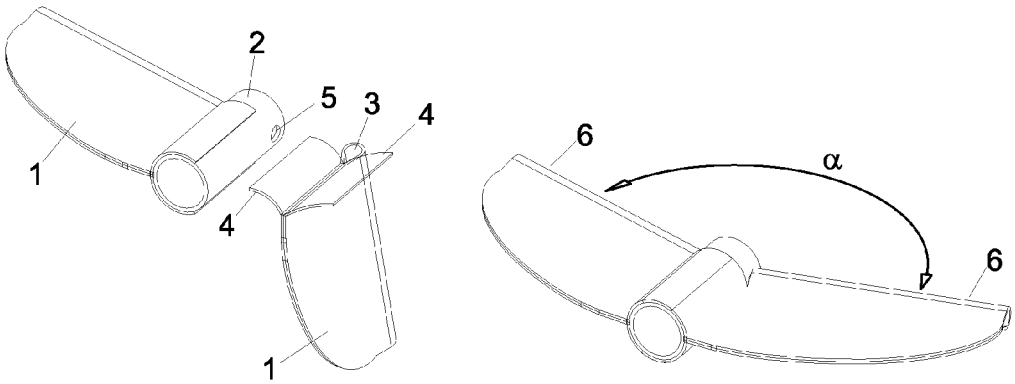
FIG. 7 is made up of figures showing the details of bonding the blades at the PVC tube of a flexible propeller according to the invention "flexible propeller and uses for small vessels"
Figure 8:
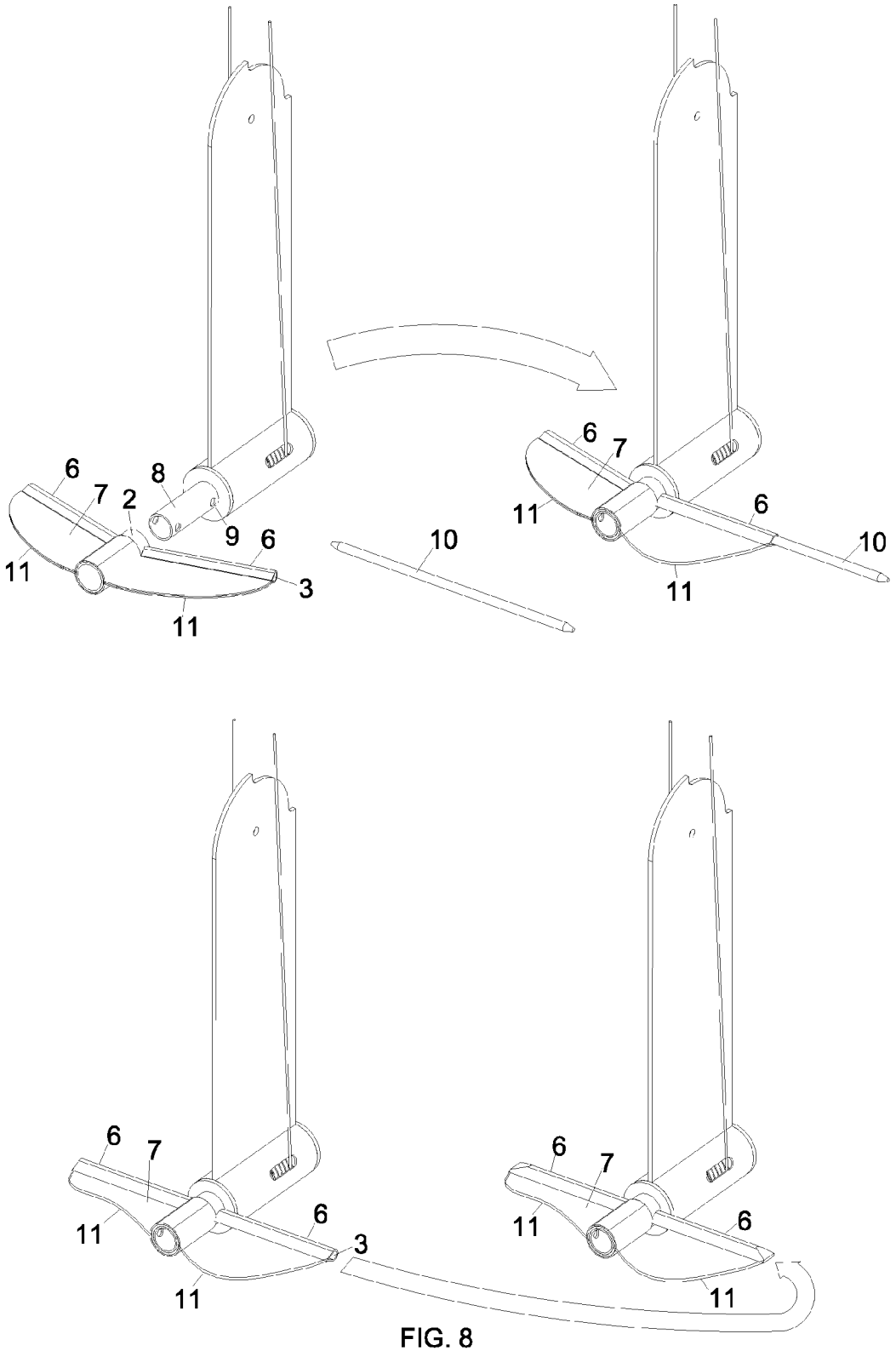
FIG. 8 is made up of figures illustrating the installation of propeller in a sterndrive shaft according to the invention "flexible propeller and uses for small vessels"

The flexible propeller may be produced in various ways. One example is by injecting rubber material in a mold. The following describes a way to manufacture a propeller from flexible PVC fabric. Basically it uses two pieces of flexible PVC fabric 1, cut as detailed in FIG. 5 and a rigid PVC tube 2, which has a hole as the detail of FIG. 5. Flexible PVC fabric 1 will form the propeller blades and the rigid PVC tube 2 will provide rigidity to the propeller shaft. First adhesive is applied to flexible PVC fabric 1 in the hatched region, as shown in FIG. 6. Later on fabric 1 is bent on its axis of symmetry and glued as FIG. 6. As the region close to the fold has no application of adhesive, a hole 3 is formed in the region of the fold. Subsequently, each of the fabric 1 is glued to the tube 2 as shown in FIG. 7. The fabric 1 should be positioned so that the hole 3 close to the flap 4 coincides with the hole 5 of tube 2. The tab 4 involves the tube 2, one for each side, providing a large area of bonding. It can be seen that the leading edges 6 of the blades form an angle $\alpha$ with less than 180 degrees. FIG. 8 shows how propeller 7 is mounted on the shaft 8 of the sterndrive. First the tube 2 is inserted into the shaft 8 until the moment that their holes 5 are aligned with the holes 9 present on the shaft 8 of the sterndrive. Subsequently, a rigid rod 10 is inserted through hole 3 passing through the hole 5 and the hole 9 present on shaft 8 of the sterndrive. The rod 10 passes through holes 3 of the two blades, forcing the leading edge 6 to be aligned. As a result, the trailing edge 11 of the blade is loose. The smaller the angle $\alpha$, the looser will be the trailing edge 11 of the blades and the lower the effective pitch of the propeller 7. Therefore the angle $\alpha$ determines the value of the pitch of the propeller 7. To prevent the rod 10 to move out of its position, the holes 3 at the ends of the blades are sealed with glue, as indicated by the arrow at the bottom of FIG. 8. The propeller 7, as it is made of flexible material, can be deflected around the rod 10 by the pressure exerted by the water and assuming a helical shape, generating a propulsive force F whose direction coincides with the axis 8 and is always pointing from the trailing edge 11 to the leading edge 6 of the blades, regardless of the direction of rotation of the propeller 7.

Figure 9:
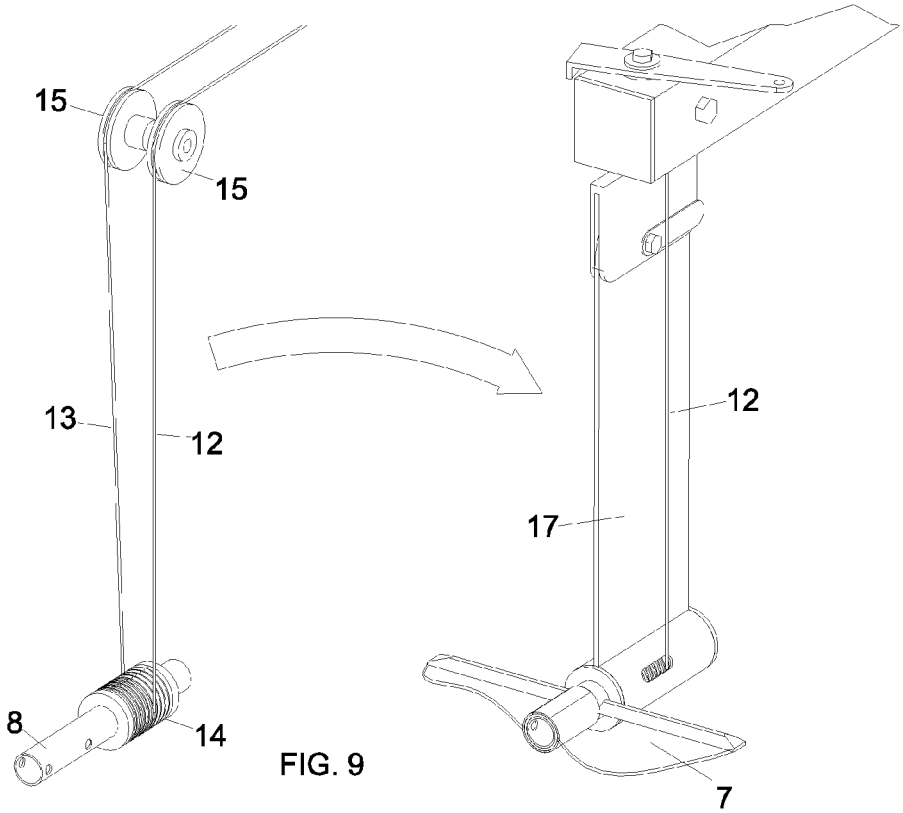
FIG. 9 is made up of figures that show a sterndrive that can be used with a flexible propeller according to the invention "flexible propeller and uses for small vessels"

FIG. 9 shows a sterndrive that can be used with the flexible propeller 7. The working principle consists of two cables 12 and 13, which are wound around a threaded spindle 14 present on the shaft 8. The cable 12 is wound clockwise and the cable 13 in a counterclockwise direction. Cables 12 and 13 go through two independent pulleys 15 and can be driven along alternately making the shaft 8 of the propeller 7 rotate alternately, sometimes in one direction, sometimes in another.

Figure 10:
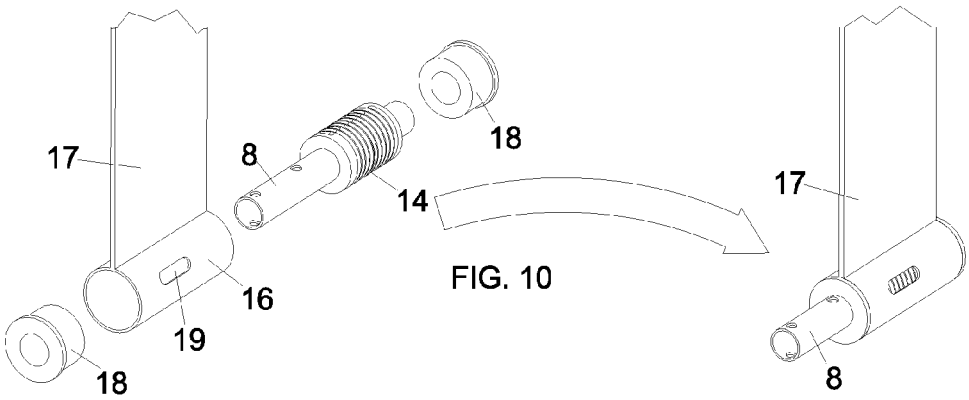
FIG. 10 is made up of figures illustrating the mounting of the propeller shaft in the tube positioned at the bottom of the sterndrive according to the invention "flexible propeller and uses for small vessels"
Figure 11:
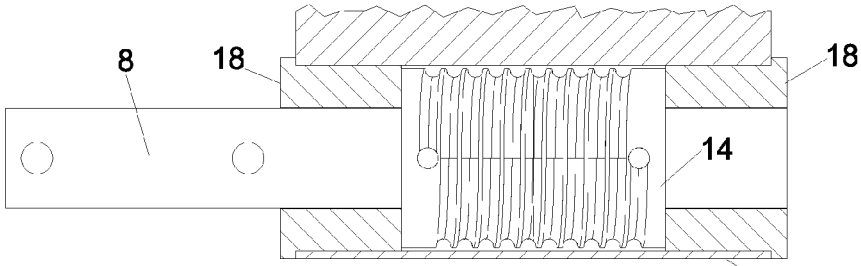
FIG. 11 shows a sectional view of the tube and bushings located at the bottom of the sterndrive, showing the threaded spindle present in the propeller shaft according to the invention "flexible propeller and uses for small vessels"

The threaded spindle 14 is fixed on the shaft 8, thus, there is no relative motion between them. The shaft 8 is mounted on the tube 16 located at the bottom of the plate 17 of the sterndrive, as shown in FIG. 10. The shaft 8 is mounted supported by two bushings 18 which are fitted at the ends of the tube 16. The threaded spindle 14 is a thread whose root fillet has a round profile to accommodate the cables 12 and 13, which also have a round section. FIG. 11 shows a sectional view of the tube 16 and bushings 18, where it appears the shaft 8 also. It is noticed that the threaded spindle 14 serves as a guide to cable winding. The cable is positioned between the root of the fillet and the inner wall of the tube 16. The tube 16 has two slots 19, one on each side, allowing the cable to pass through it. The slot 19 is elongated to allow longitudinal movement of the cable as it rolls up and unrolls.

Figure 12:
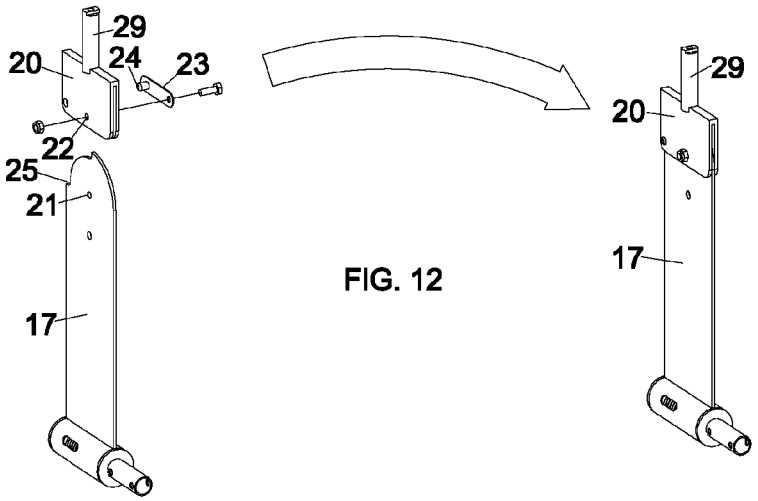
FIG. 12 is made up of figures that illustrate the assembly of the plate in the base of a sterndrive according to the invention "flexible propeller and uses for small vessels"

The plate 17 is mounted in the base 20 of the sterndrive in an articulated manner, as shown in FIG. 12. For this purpose the plate 17 is positioned in a way that the holes 21 and 22 are aligned. A spring 23 having a pin 24 is then positioned as shown in FIG. 12 and the parts are joined by screw and nut.

Figure 13:
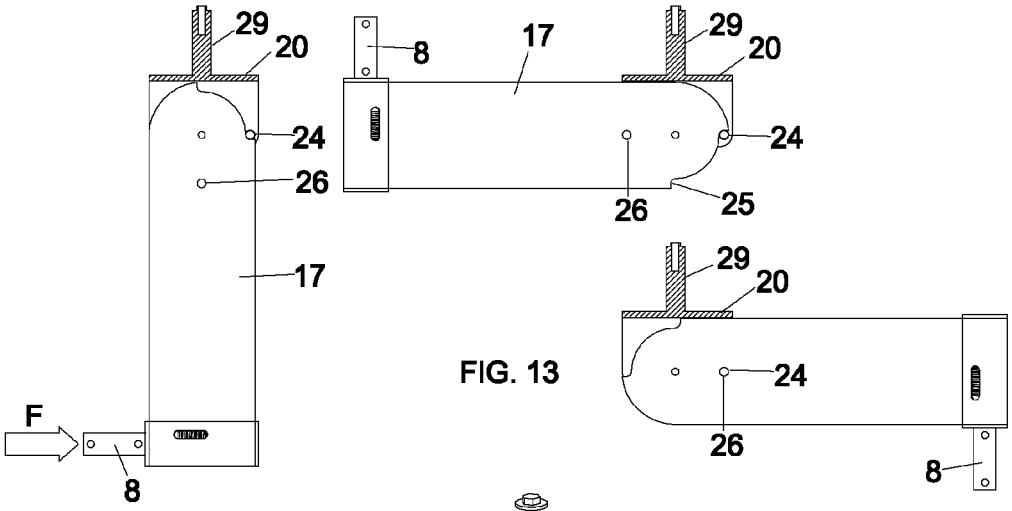
FIG. 13 is made up of figures illustrating the operation of a retraction and locking mechanism of a sterndrive according to the invention "flexible propeller and uses for small vessels"

FIG. 13 shows a configuration example of the spring 23, plate 17 and base 20 of the sterndrive. In this example the pin 24 abuts the shoulder 25 present on the plate 17 while the force F acts on the axis 8, maintaining the assembly in operating condition (propeller 7 was omitted). In a collision with an object, the plate 17 of the sterndrive is free to rotate backwards. And, for a situation of transport or storage, the plate 17 can be taken forward and kept locked. To do so, it must first pull the pin 24, deflecting the spring 23 until the moment in which the pin 24 releases the movement of the plate 17 forward. The plate 17 can then be rotated forward until the moment that the pin 24 engages the hole 26 present on the plate 17 by the force of the spring 23.

Figure 14:
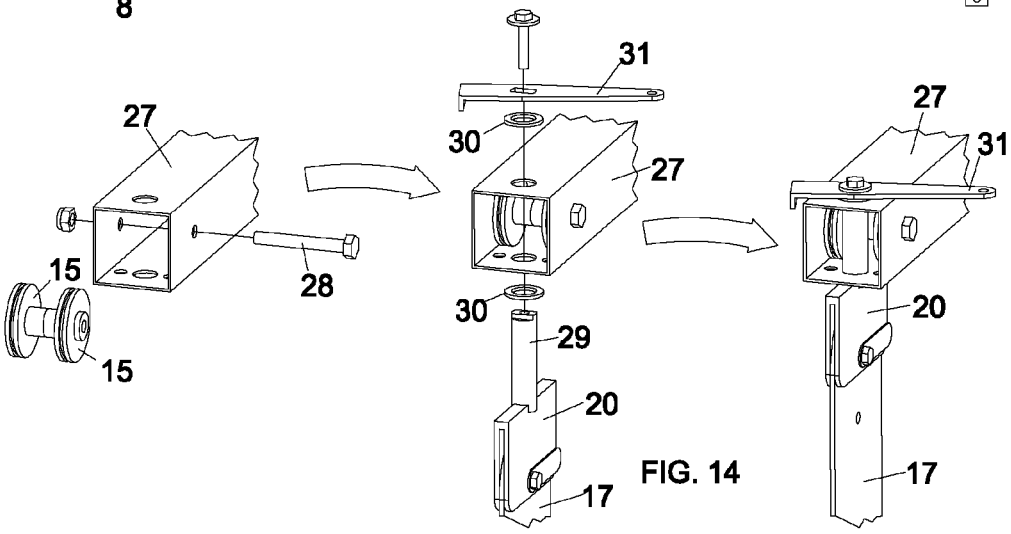
FIG. 14 is made up of figures showing the detail of the assembly of the mechanical parts of the propulsive system according to the invention "flexible propeller and uses for small vessels"

FIG. 14 shows the detail of the assembly of the mechanical assemblies making up the propulsion system, which are mounted on the end of a tube 27. First, a pair of pulleys 15 is mounted in the end of the tube 27. The pair of pulleys 15 rotates, independently, around the axis 28. Subsequently the sterndrive base 20 is mounted on so that it can freely rotate around the axis 29 of base 20. Washers 30 are positioned on both sides to facilitate articulation and finally the control lever 31 is mounted on the upper part of axis 29, being linked thereto.

Figure 15:
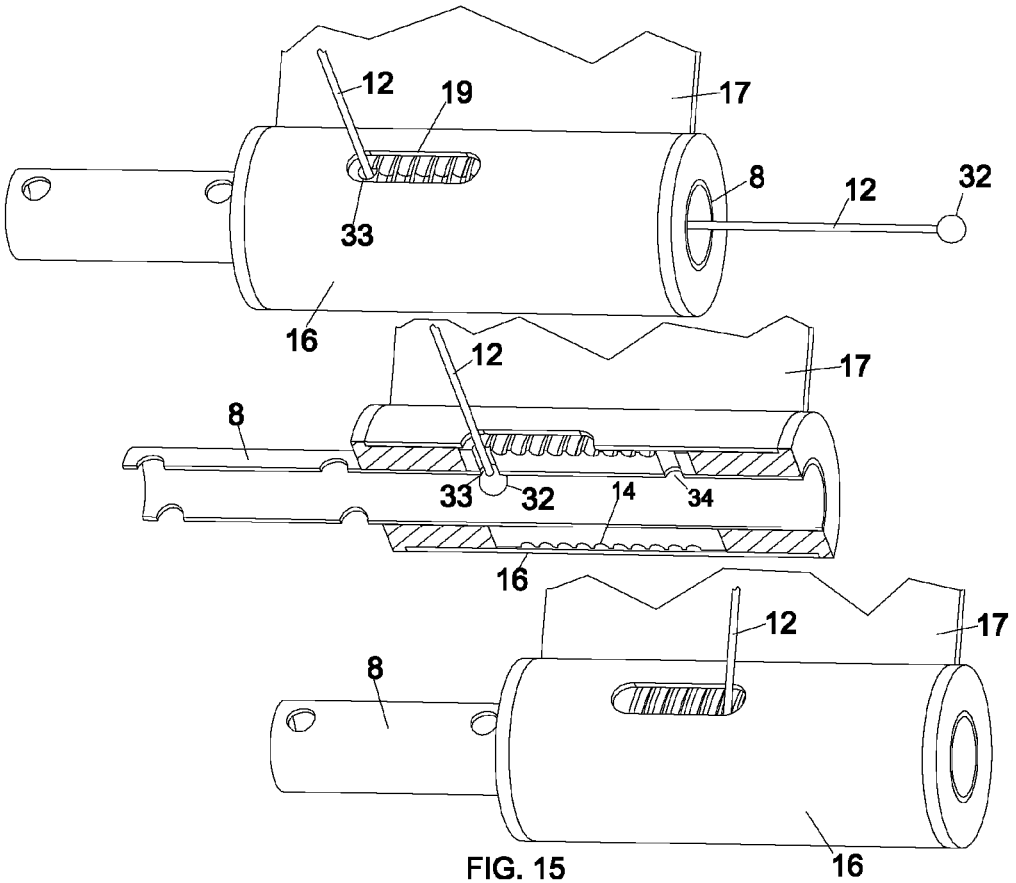
FIG. 15 is made up of figures illustrating the process of mounting the cables of the propulsion system according to the invention "flexible propeller and uses for small vessels"
Figure 16:
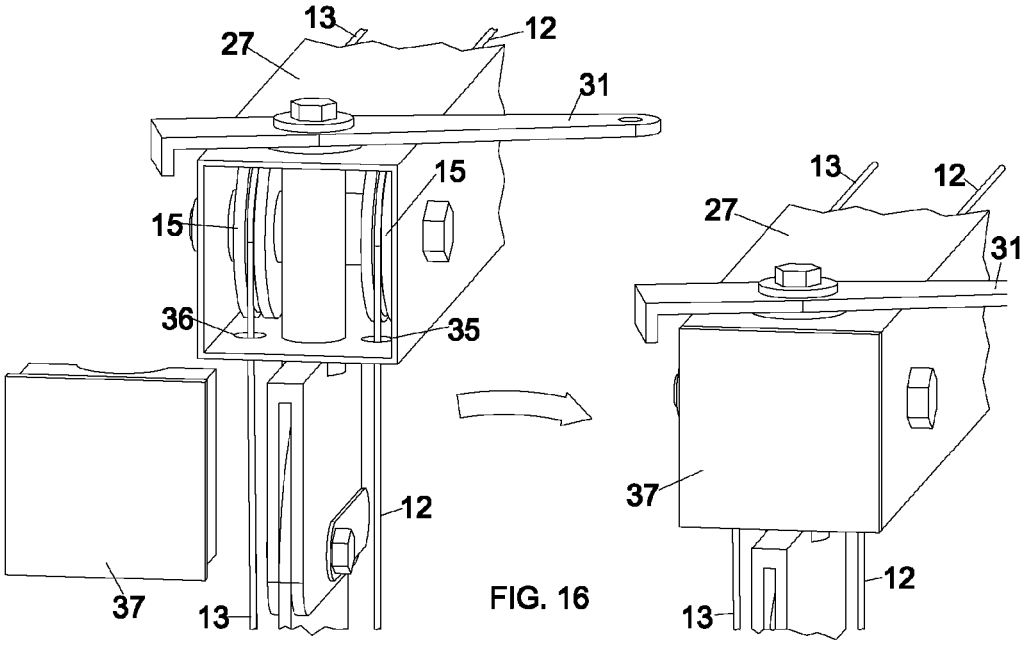
FIG. 16 is made up of figures that complement the understanding of the process of mounting the cables of the propulsion system according to the invention "flexible propeller and uses for small vessels"
Figure 17:
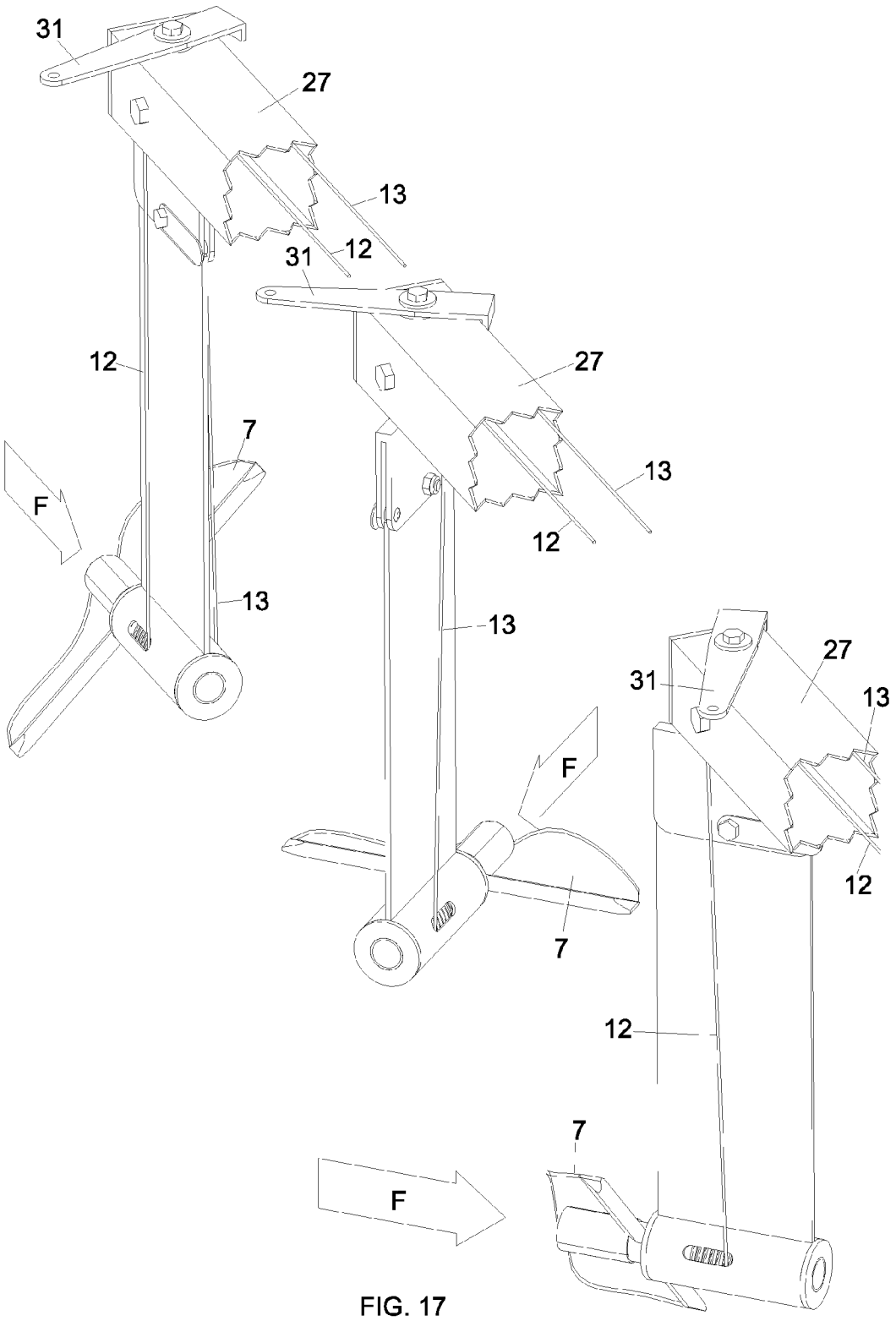
FIG. 17 is made up of figures showing the operation of the propulsion system according to the invention "flexible propeller and uses for small vessels"

FIG. 15 illustrates a manner of assembling the cable 12 and 13, which are identical and have a ball terminal 32 at one of its ends. First must rotate the shaft 8 until the moment when hole 33 is aligned with the slot 19. At this time the cable end 12, which has no ball terminal 32, is inserted into the tube shaft 8 through the hole 33 and out through the slot 19. The cable 12 can be pulled completely until the ball terminal 32 stops at hole 33, as shown in the sectional drawing of FIG. 15. The shaft 8 can then be rotated about 6 times (this number is only given as an example and may be larger or smaller depending on the application), so that the cable 12 winds the threaded spindle 14, being positioned between the root of the screw thread and the inner wall of the tube 16. After six rounds, it must be rotated slightly more until the hole 34 is aligned with the slot (which does not appear in the FIG. 15) located on the opposite side with respect to the plane of symmetry of the plate 17. At this time the end of the cable 13 without ball terminal 32 is inserted through the tube 8, through hole 34 and out through the slot on the opposite side. The cable 13 can be pulled completely until the ball terminal 32 stops at hole 34. Now it is possible to pull the cable 12 causing a rotation on shaft 8, causing the cable 13 winds the threaded spindle 14 while the cable 12 unwinds. As shown in FIG. 16, the end of the cable 12 must then pass through the hole 35 located in the lower right wall of the tube 27 and subsequently over the pulley 15 and then out the opposite end of the tube 27. Similarly, the cable 13 must pass through the hole 36 located in the lower left wall of the tube 27 and subsequently over the pulley 15 and then out the opposite end of the tube 27. To conclude this portion of the assembly, a square terminal 37 is inserted into the end of tube 27. This terminal serves as finishing and also to prevent the cables 12 and 13 from leaving the groove of pulley 15 as the front wall of the square terminal 37 is located close to the pulley 15, preventing the cables 12 and 13 leave the groove. The upper wall of the tube 27 is also located near the pulleys 15 preventing the cables 12 and 13 leave the groove. Thus, at the end of these operations, the propulsion system is mounted. FIG. 17 shows a complete propulsion system. The working principle consists in pulling alternately drive cables 12 and 13, which will make the propeller 7 rotate alternately clockwise and anti-clockwise. The cables 12 and 13 can be driven directly by the user's hands or feet, through different mechanisms. As shown in FIG. 17, the lever 31 allows the sterndrive to rotate about 45° on each side, enabling vectoring the driving force F of propeller 7, while the cables 12 and 13 may continue to be actuated. This propulsion system can be adapted for a variety of small boats.

Figure 18:
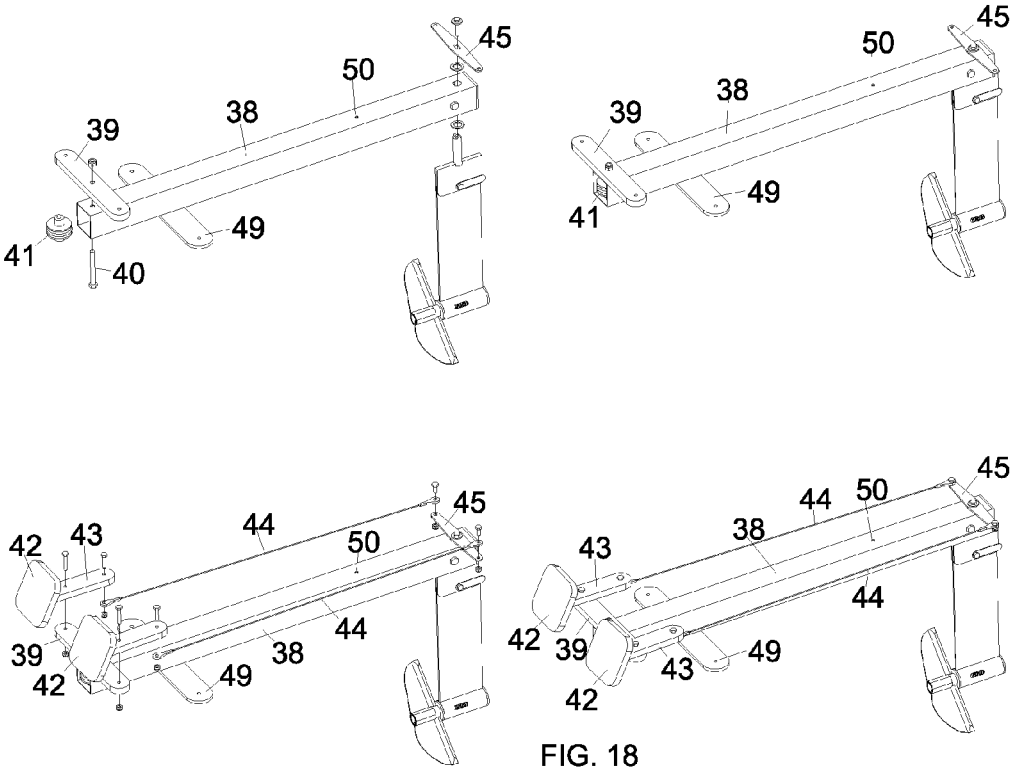
FIG. 18 is made up of figures showing a device that uses the propulsion system according to the invention "flexible propeller and uses for small vessels"
Figure 19:
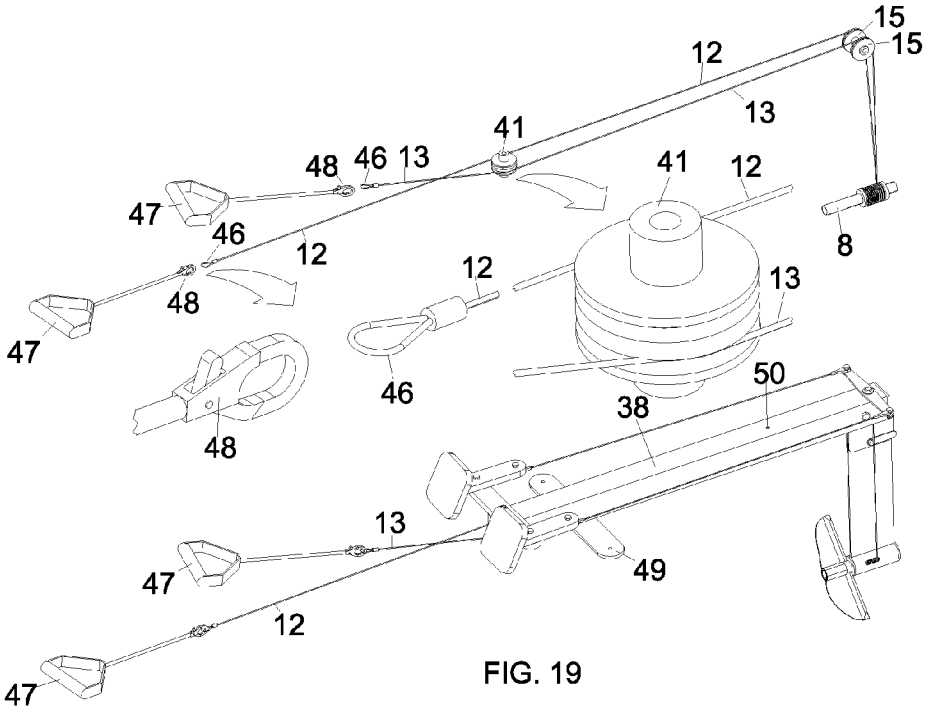
FIG. 19 is made up of figures that show the installation of cables in a device that uses the propulsion system according to the invention "flexible propeller and uses for small vessels"
Figure 20:
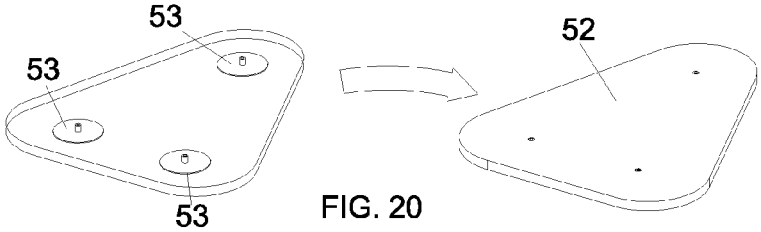
FIG. 20 is made up of figures showing a base containing three inserts that allow the assembly of a device that uses propulsion system according to the invention "flexible propeller and uses for small vessels"
Figure 21:
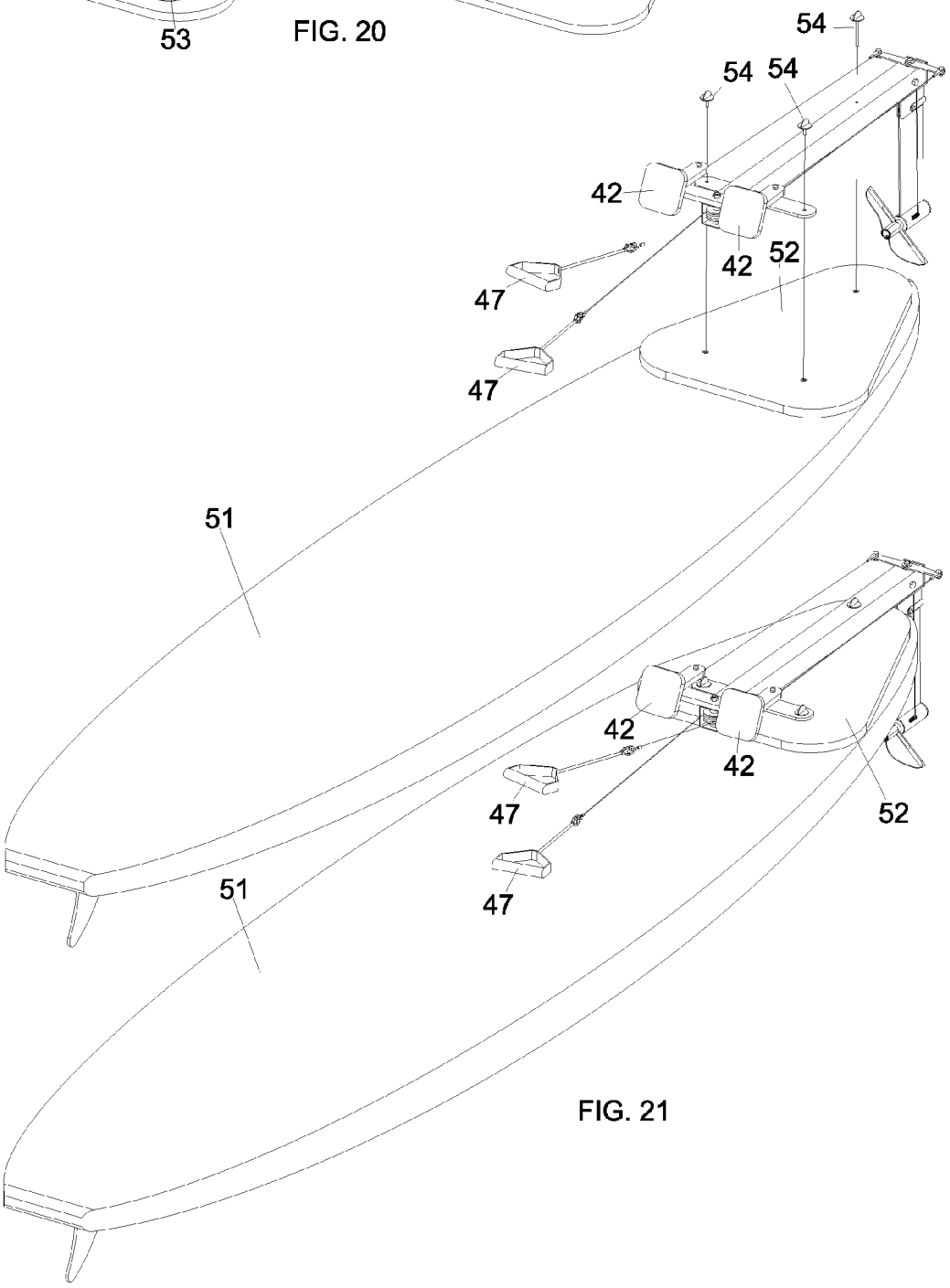
FIG. 21 is made up of figures showing the assembly of a device that uses the propulsion system according to the invention "flexible propeller and uses for small vessels" on a base bonded to the front of a board.
Figure 22:
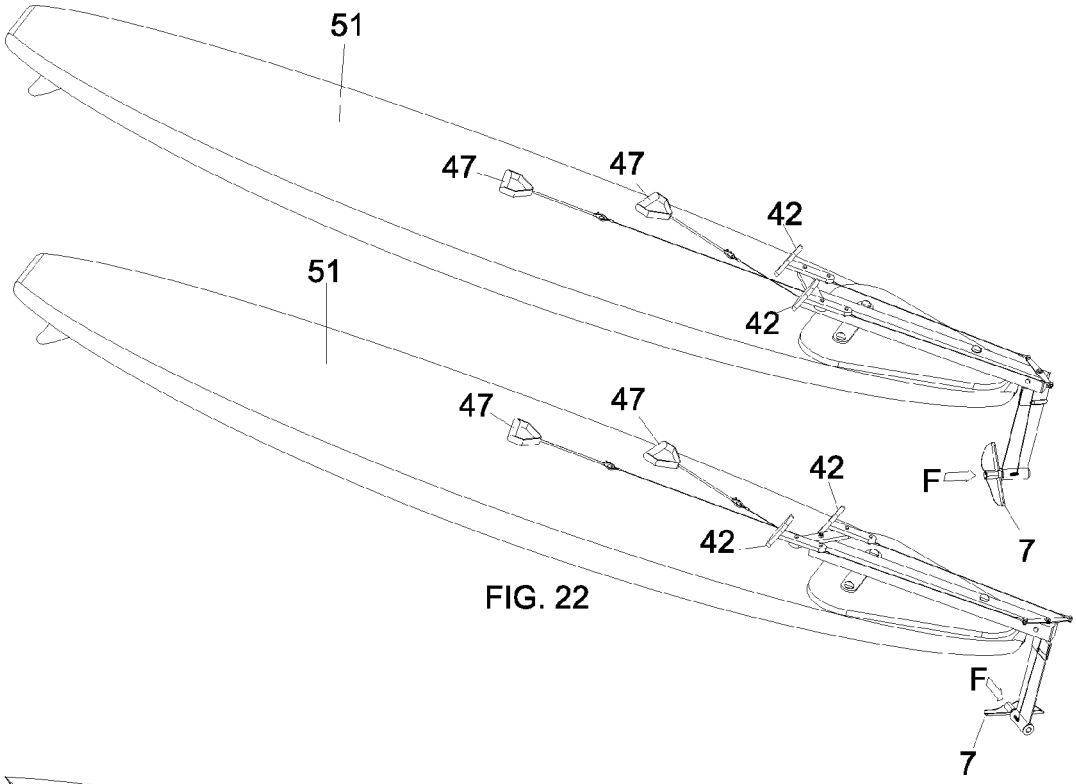
FIG. 22 is made up of figures showing the operation of a device using the propulsion system according to the invention "flexible propeller and uses for small vessels" mounted on the front of a board.

Below you will see a device that uses the propulsion system and can be adapted to stand-up paddle boards, as well as canoes and kayaks. According to FIG. 18, at one end of the tube 38 is mounted on the propulsion system. At the other end is mounted a lever 39 in an articulated manner to the axis 40. In this same axis 40 is mounted a pulley 41 on the inside of the tube 38. The pulley 41 has two grooves, one for the cable 12 and one for the cable 13. Pedals 42 are mounted on the end of the lever 39 in an articulated manner. The bars 43 of the pedals 42 are then connected via cable 44 to the lever 45, as shown in FIG. 18. According to FIG. 19, the cables 12 and 13, after passing through pulleys 15, followed by the inner tube 38 passing through the pulley 41 and following to the outside of the tube 38. After going through the pulley 41, cable 12 and 13 must reverse sides to allow them are being supported by pulley 41. The end of the cable 12 and 13 should make loops 46 to enable the handles 47 being fixed by means of hooks 48. The device described above can be fixed on vessels in three points: two holes located at the ends of the plate 49, welded at the bottom of the tube 38, and a third hole 50 located at the front of the tube 38, near the propulsion system. The following will be presented a way to fix the device on a board 51. Therefore, a base 52 similar to a traction pad can be pasted on the front of the board 51. As shown in FIG. 20, this base 52 should have three inserts 53, suitably spaced so that the device can be mounted on the base 52. The base 52 can be made using, for example, an injection mold, where before injection of the rubber, three inserts 53 are positioned inside the mold. After the injection process, inserts 53 would be inside the base 52, as suggested by FIG. 20. These inserts 53 should have a fixing mechanism, for example, an internal thread, so that the device can be mounted to the base using bolts 54. As the inserts 53 are spaced apart, the base 52 has a degree of flexibility which allows it to adapt to different conditions of curvature of the deck, being possible to be glued in a variety of stand-up paddle boards. According to FIG. 21, being the board 51 equipped with the base 52, the device can be mounted with the use of three screws 54. FIG. 22 shows how the device works. The occupant should sit on the board 51, and then trigger handles 47 alternately with the hands while directing the vessel with the feet, through the pedals 42. Removing the device, the board 51 can be used normally, since the base 52 is flat and do not interferes the use of the board.

Figure 23:
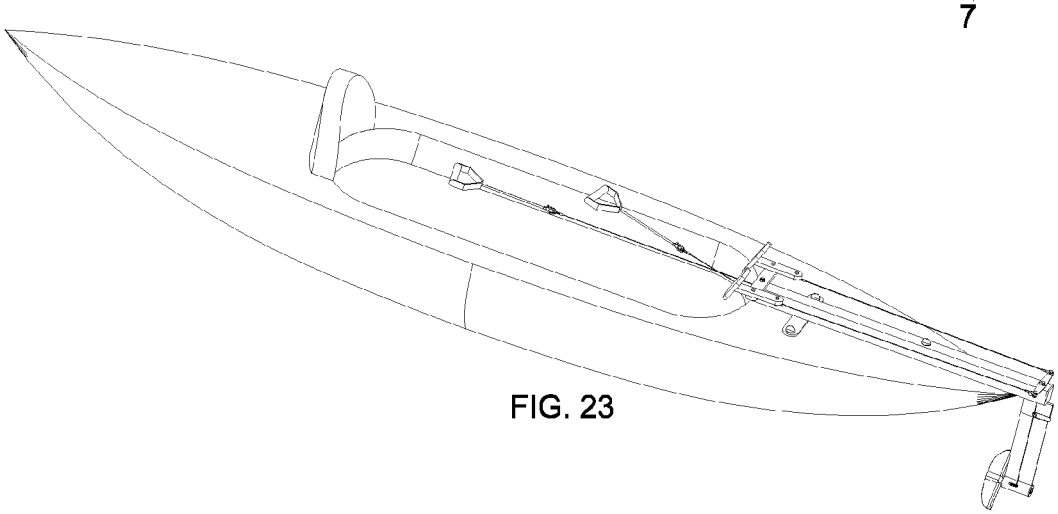
FIG. 23 is a perspective view showing a device using the propulsion system according to the invention "flexible propeller and uses for small vessels" mounted on the front of a kayak.
Figure 24:
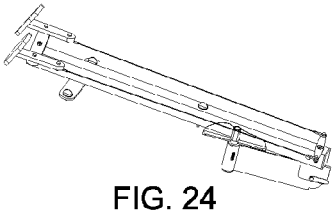
FIG. 24 is a perspective view showing a device using the propulsion system according to the invention "flexible propeller and uses for small vessels" in a compact condition.

The device can also be adapted to kayaks as shown in FIG. 23. The kayak must include three attachment points to permit mounting on the device. FIG. 24 shows the device with the sterndrive collapsed for transport or storage. It can be observed that the device is simple and compact, occupying a small volume.

Figure 25:
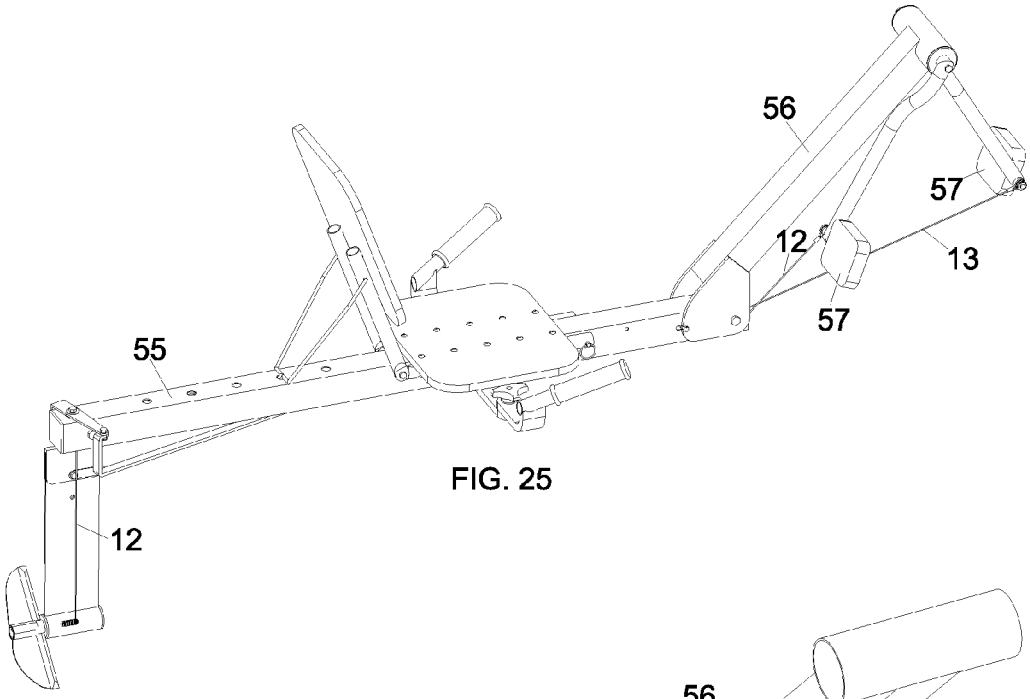
FIG. 25 is a perspective view showing a foldable structure to be used with the propulsion system according to the invention "flexible propeller and uses for small vessels"
Figure 26:
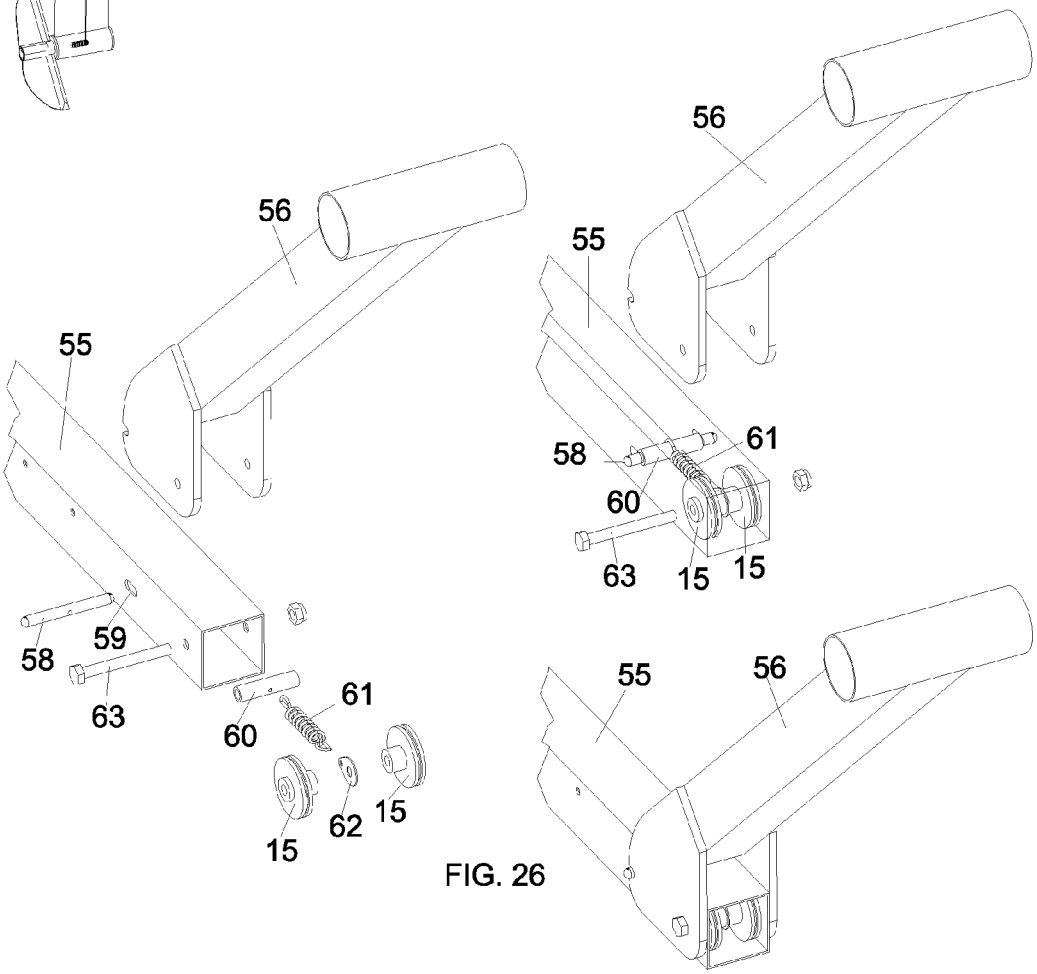
FIG. 26 is made up of figures illustrating the mounting of the secondary structure at the main structure of a foldable structure to be used with the propulsion system according to the invention "flexible propeller and uses for small vessels"

As FIG. 25 illustrates a folding structure is designed to be used with the propulsion system, so that it can be actuated by the legs of the user. It basically consists of a main structure 55 and a secondary structure 56 serving as a support for the pedals 57. The propulsion system is mounted on the rear of the main structure 55 and cables 12 and 13 pass through the tube of the main structure 55 coming out on front of it. On the front of main structure 55 is mounted in pivotable manner, the secondary structure 56, as shown in FIG. 26. First, a pin 58 is mounted in the slot 59 present on the main structure 55. The assembly procedure consists of introducing a guide tube 60 from the front of the main structure 55 until the axial hole of the guide tube 60 is aligned with the slot 59. At this time, the pin 58 can be inserted into the axial hole of the guide tube 60 until the moment when the hole present in the central part of pin 58 is aligned with the hole present in the central part of tube guide 60. Subsequently the hook end of the tension spring 61 can be introduced into the tube guide 60 hole passing through the pin 58 hole and eliminating thus the possibility of axial displacement between the guide tube 60 and pin 58. The hook from the opposite end of the tension spring 61 is fitted in the hole present in the plate 62. At this time the secondary structure 56 and two pulleys 15 are mounted on the same shaft 63 and the plate 62 is also mounted in the central part of this same shaft 63. To the assembly, secondary structure 56, the pulleys 15 and the plate 62 are positioned relative to the front of the main structure 55 so that the holes are aligned, as suggested in FIG. 26. When the holes are aligned, the shaft 63 can be introduced, completing the assembly of these elements.

Figure 27:
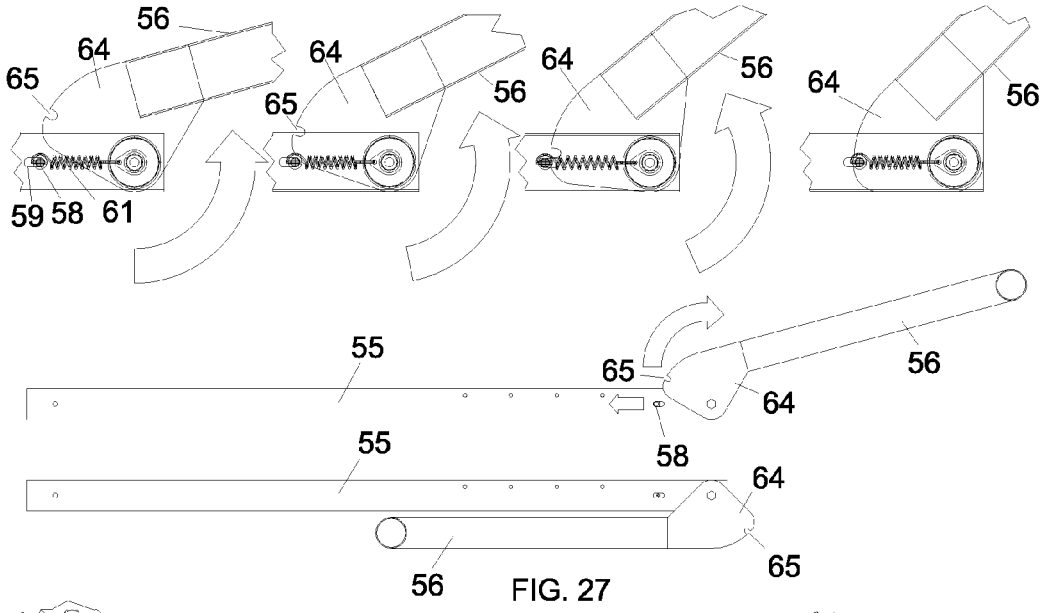
FIG. 27 is made up of figures showing how it works the refraction, extension and locking mechanism of the secondary structure of a foldable structure to be used with the propulsion system according to the invention "flexible propeller and uses for small vessels"

FIG. 27 shows how secondary structure 56 locking mechanism works. The tension spring 61 maintains the pin 58 constantly pressed against the end of the slot 59. To lock the secondary structure 56 in the operating position, simply rotate it in a counterclockwise direction, according to FIG. 27. As the secondary structure 56 is rotated, the plate 64 gradually triggers the pin 58 which is automatically inserted into the slot 65 present on the plate 64, keeping the secondary structure 56 locked in the operating position. To retract, you must pull the pin 58 with the fingers toward the other end of the slot 59, as suggested by the arrow in FIG. 27, until the pin 58 clears the slot 65 present on the secondary structure 56 allowing it to rotate clockwise. The secondary structure 56 can be rotated to be parallel to the main structure 55. This condition minimizes volume for transport and storage.

Figure 28:
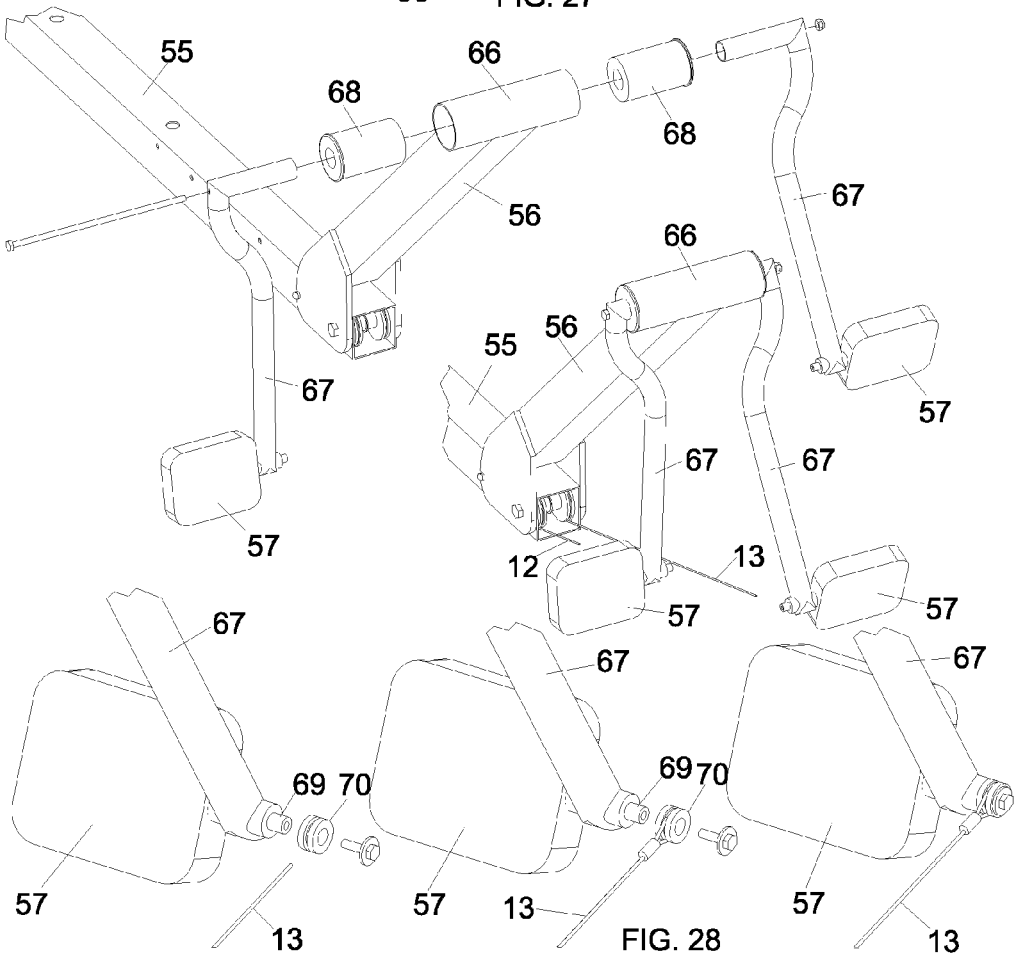
FIG. 28 is made up of figures showing the mounting of cables and levers with pedals in a foldable structure to be used with the propulsion system according to the invention "flexible propeller and uses for small vessels"

As shown in FIG. 28, the end of the secondary structure 56 is a tube 66 for mounting levers 67 with pedals 57. To assembly the levers 67, first the bushings 68 are inserted into each end of the tube 66. Then the levers 67 can then be introduced, one on each side. Finally a bolt and nut are added. The levers 67 are free to rotate around the axis of the tube 66.

After mounting the propulsion system at the rear end of the main structure 55, the cables 12 and 13 passes through the tube and out at the front of it, passing under the grooves of pulley 15, as suggested by FIG. 28. Each one of the levers 67 has a shaft 69 for fixing the end of the cable 12 and 13. The end of each cable is then fixed around lugs 70. The lug 70 is then mounted on the shaft 69. To do so, first the hole of lug 70 is inserted in the shaft 69 and a subsequent bolt is then added. The lug 70 has freedom of rotation around the shaft 69. This way, you can trigger the pedals 57 with the feet, actuating the propeller 7.

Figure 29:
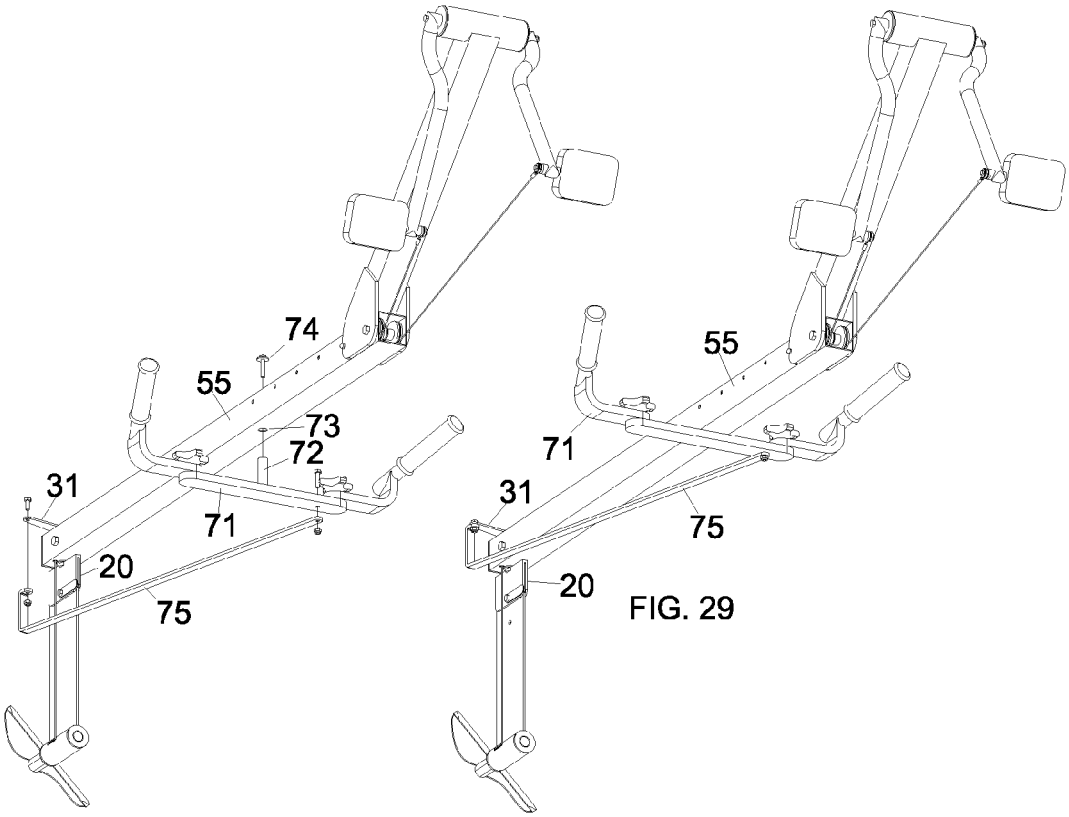
FIG. 29 is made up of figures showing the assembly of a handlebar and connecting rod in a foldable structure to be used with the propulsion system according to the invention "flexible propeller and uses for small vessels"

As shown in FIG. 29, handlebar 71 is mounted on the main structure 55. To do so, the shaft 72 located in the central position of the handlebar 71 is inserted passing through the hole 73 located in the main structure 55. Subsequently a bolt 74 is fixed in the upper position of the shaft 72. The handlebar 71, which has freedom of rotation around the axis 72, is connected to the lever 31 by means of a rod 75. The lever 31 is fixed to the sterndrive base 20, which is pivotally mounted on the main structure 55, allowing the user to drive the boat through the handlebar 71. The ends of the handlebar 71 may be articulated to allow adjustment according to the height of the user and also to assume a more compact condition for transport and storage.

Figure 30:
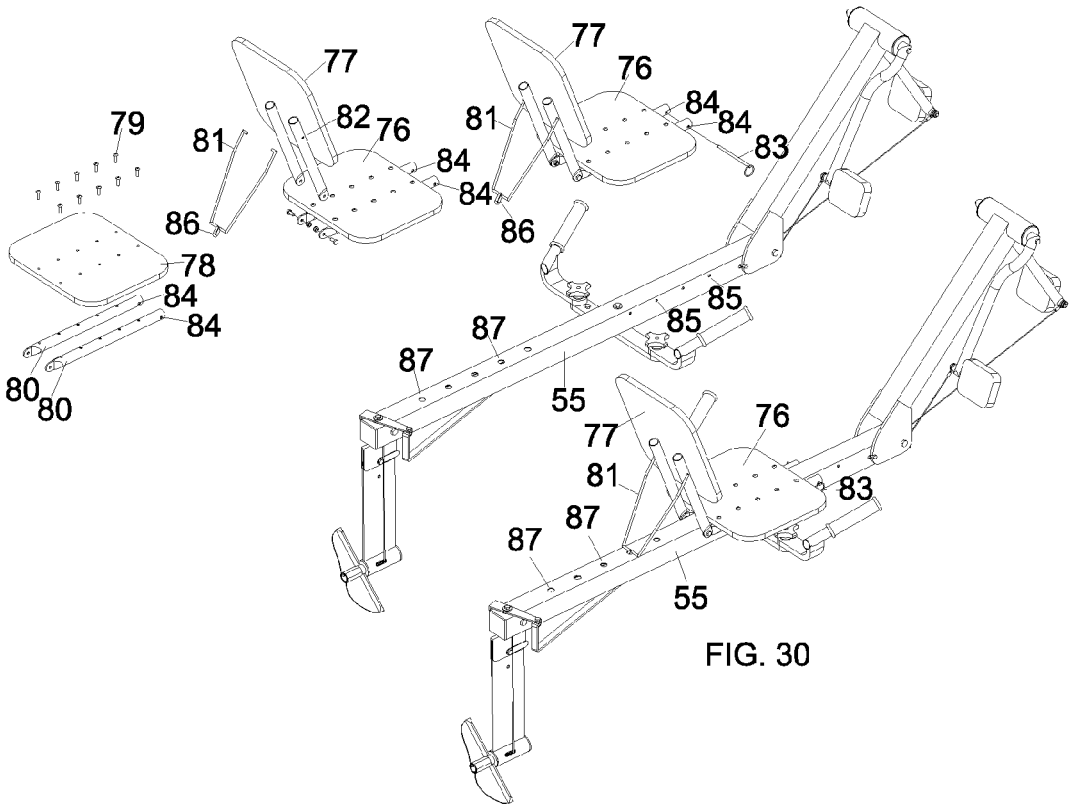
FIG. 30 is made up of figures showing the mounting of a seat in a foldable structure to be used with the propulsion system according to the invention "flexible propeller and uses for small vessels"

FIG. 30 illustrates the assembly of a seat, which consists of the bottom 76 and backrest 77. The bottom 76 consists of a rigid rectangular base 78, which is joined by rivets 79 to a pair of tubes 80, each one having one end formed and drilled to be mounted on the backrest 77, which is constructed in the same way. A triangular support 81 is mounted at backrest 77. It consists of a round section metal bar, bent as shown in FIG. 30. On the sides of the tubes of the backrest 77 there are holes 82 where the triangular support 81 is embedded. The procedure consists of deforming elastically the triangular support 81 which can then be fitted into the holes 82. After fitting, the triangular support 81 returns to its original shape, remaining positioned on the backrest 77 of the seat. The seat is fixed to the main structure 55 by a pin 83 and can be fixed in different positions to adjust according to the length of user's legs. The fixing procedure is to position the seat so that the holes 84 present at the ends of the tubes 80 are aligned with the holes 85 present on the side walls of the main structure 55. At this point the pin 83 can be inserted, thus fixing the seat to the main structure 55. The notch 86 at the tip of the triangular support 81 can then be fitted into one of the holes 87 in the upper wall of the tube of main structure 55, providing the necessary support for the backrest 77. This system allows to adjust the inclination of the backrest 77 by changing the hole 87 where the notch 86 is attached.

Figure 31:
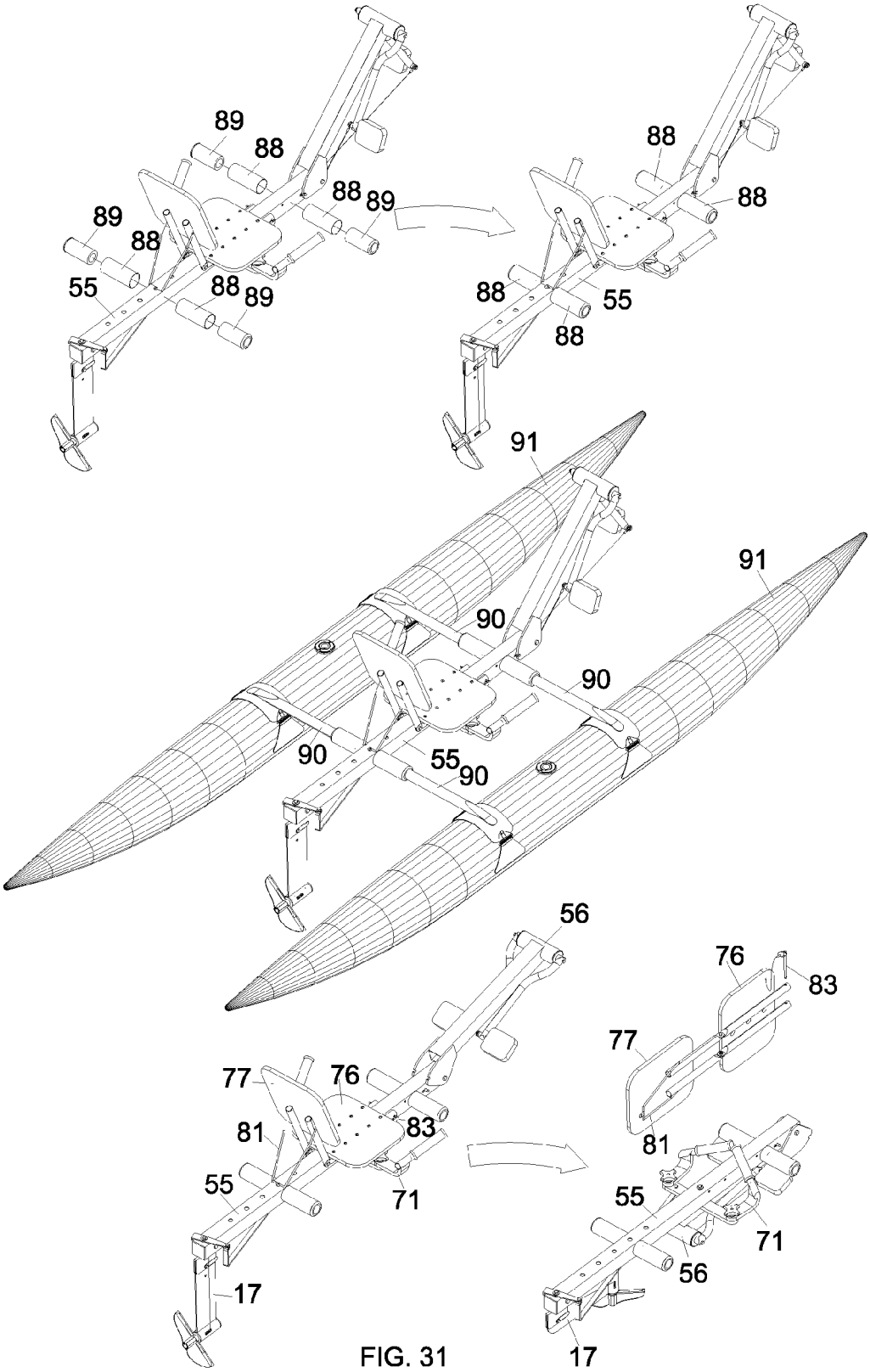
FIG. 31 is made up of figures showing a foldable structure to be used with the propulsion system according to the invention "flexible propeller and uses for small vessels" adapted for use with a pair of floats arranged in a catamaran configuration.

FIG. 31 shows how the folding structure can be used in a catamaran configuration. To do so, four tubes 88 are welded to the sides of the main structure 55 which subsequently receives sleeves 89. Four connecting rods 90 can then be assembled to the tube 88 connecting the main structure 55 to a pair of floats 91, arranged in a catamaran configuration. The folding structure can assume a compact condition for a transport or storage, as can be seen in FIG. 31. The plate 17 can be retracted forward and maintained locked, the secondary structure 56 can be retracted to be parallel to the main structure 55, the seat can be removed by simply removing the pin 83, and the ends of the handlebar 71 can be rotated to assume a more compact condition. These operations can be carried out quickly and without the need of any tools.

Figure 32:
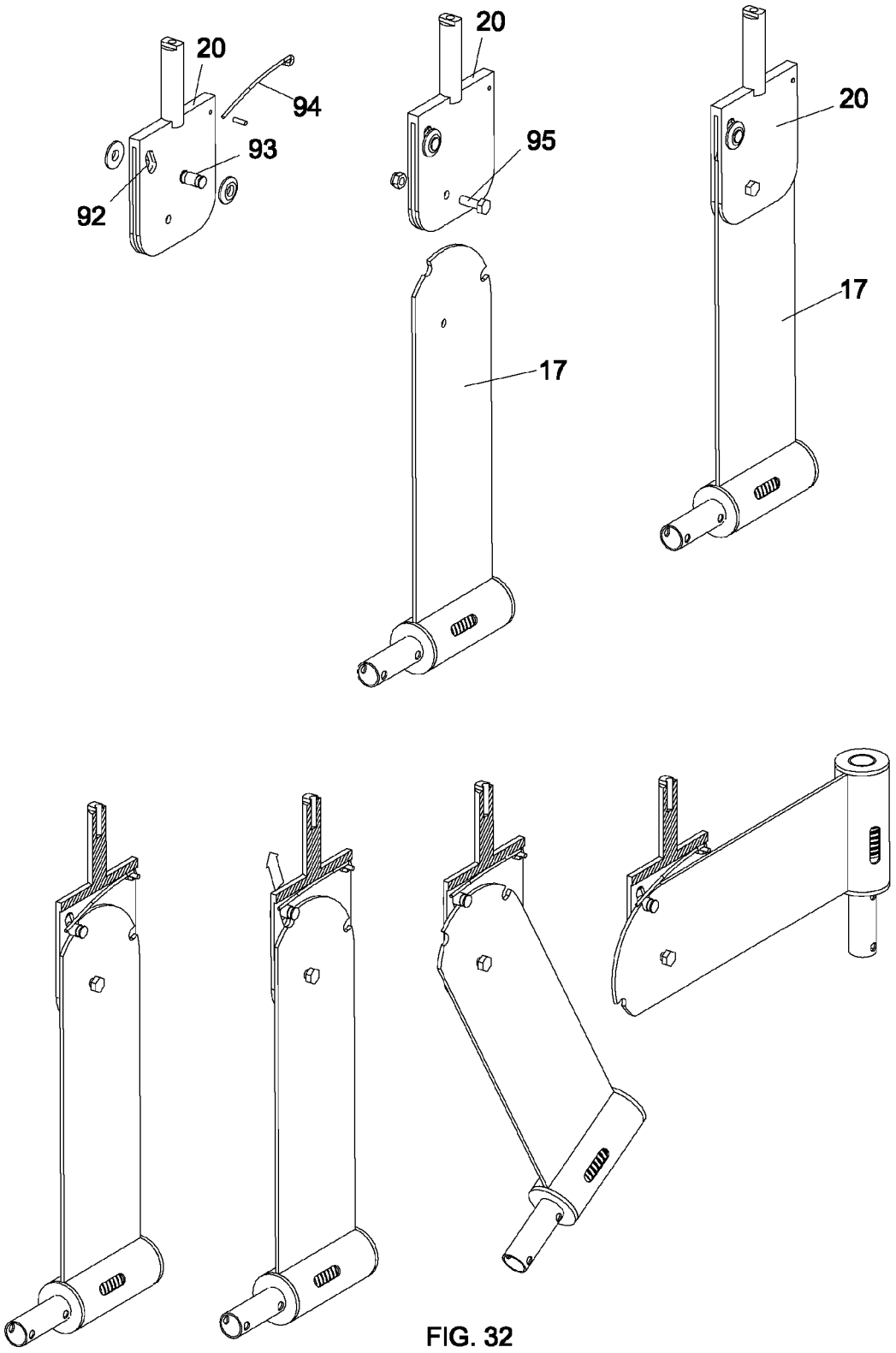
FIG. 32 is made up of figures that present a mechanism for retracting and locking the sterndrive of a propulsion system according to the invention "flexible propeller and uses for small vessels".

FIG. 32 presents a mechanism to retract and lock the sterndrive. The base 20 has a slot 92, in which is mounted a pin 93 so as to be able to move longitudinally along the slot 92. A wire spring 94 is also mounted on the base 20 to constantly press the pin 93 against the lower end of slot 92. Finally the plate 17 is mounted pivotable about the axis 95. The plate 17 has slots on its top to snap the pin 93. To retract the sterndrive just pull the pin 93 as indicated by the arrow, unlocking the slot and allowing the plate 17 to rotate. When the plate 17 is at an angle of approximately 90 degrees, the pin 93 will automatically snap into another slot, pushed by the wire spring 94, keeping the plate 17 locked in the retracted position.

The invention claimed is:

1. Flexible propeller and uses for small vessels characterized by presenting a propeller (96) with two blades, made of flexible material, which has two perpendicular holes inside, one hole to accommodate a rigid shaft (97) and the other, along the leading edge of the blades, to accommodate a rigid rod (100), which is inserted through the slot (101) present near the tip of the blade, passing through the hole (98) or (99) of the shaft (97), and then, the end of the blade is inserted on the rod (100), which is positioned, without dropping, along the leading edge of the propeller (96) which, by being made of flexible material, can be deflected around the rod (100) by pressure of the fluid, assuming a helical shape and generating a propulsive force F whose direction coincides with the axis (97) and is always pointing from the trailing edge of the blades to the leading edge of it, regardless of the direction of rotation of the propeller (96).

2. Flexible propeller and uses for small vessels according to claim 1 characterized by having a flexible propeller (7) comprised by two flexible fabric (1), and a rigid tube (2) and the fabric (1) are folded on its axis of symmetry and pasted to form a hole (3) passing in the region of folding, forming the propeller blades (7), and each blade (7) should then be positioned and pasted to the tube (2) such that the hole (3) close to the flap (4) coincides with the hole (5) in the tube (2) and the flaps (4) involves the tube (2), one for each side, providing a large bonding area and the leading edges (6) of the blades (7) form an angle $\alpha$ with less than 180 degrees and the angle $\alpha$ determines the value of the pitch of the propeller (7) which can be mounted on a shaft (8) so that a rigid rod (10) is inserted through the hole (3), passing through the hole (5) and the hole (9) present on the shaft (8) and the holes (3) at the ends of the blades are closed preventing the rod (10) to move out of position, and the propeller (7), as it is made of flexible material, can be deflected around the rod (10) by the pressure exerted by the water, assuming a helical shape, generating a propulsive force F whose direction coincides with the axis (8) and is always pointing from the trailing edge (11) to the leading edge (6) of the blades, regardless of the direction of rotation of the propeller (7).

3. Flexible propeller and uses for small vessels according to claim 1 characterized by having a propulsion system with the following features:

a) It has two pulleys (15) that are mounted in the end of the tube (27) so that it can rotate about the axis (28), positioned horizontally and perpendicularly to the tube (27); and b) It has a base (20) which is mounted on the end of the tube (27) so that it can freely rotate around the axis (29), positioned vertically and perpendicularly to the tube (27) and a lever (31) (45) is mounted on top of the shaft (29) being connected to it; and c) It has a plate (17) which is mounted in the base (20) in a vertical arrangement, aligned with the axis (29) and extending downwards and it may be fixed or articulated; and d) It has a tube (16) located at the bottom of the plate (17) where the shaft (8) is mounted supported by two bushings (18) which in turn are fitted at the ends of the tube (16) so that the threaded spindle (14), which is connected to the shaft (8), is positioned inside the tube (16), and the threaded spindle (14) has a screw thread whose root has a round profile to accommodate the cables (12) and (13), which also have a round section, serving as a guide for winding the cables that are positioned between the root of the thread fillet and the inner wall of the tube (16) that have two slots (19), one on each side, allowing the cable to pass through it; and e) It has two cables (12) and (13) and one end of the cable (12) is fixed close to one end of the threaded spindle (14) and one end of the cable (13) is fixed near the other end of the threaded spindle (14) and cables (12) and (13) is wound on the threaded spindle (14) from the ends to the center of the threaded spindle (14) in opposite directions of rotation, one on the right side and the other on the left side, passing through the slots (19) and thereafter over the pulleys (15) and then through out the opposite end of the tube (27), and when the cable (12) is completely unwound, the cable (13) is wrapped around the threaded spindle (14), allowing pulling the cables alternately, making the shaft (8) rotate alternately, sometimes in one direction, sometimes in another; and f) It allows that a flexible propeller (7) (96) may be mounted being connected to the shaft (8) and a force F is generated on the flexible propeller (7) (96) by pulling cable (12) and (13) alternately while, at the same time, by actuating the lever (31) (45) the assembly can rotate about 45 degrees on each side, enabling vectoring the force F.

4. Flexible propeller and uses for small vessels according to claim 3 wherein the propulsion system has a mechanism for the extension and retraction of plate (17), and this mechanism consists of a slot (92) at the base (20) in which is mounted a pin (93) so as to be able to move longitudinally along the slot (92) and a wire spring (94) is also mounted in the base (20) to constantly press the pin (93) against the lower end of the slot (92) and the plate (17) is mounted for pivotable about the axis (95) and the plate (17) has notches on its top for engagement of the pin (93) which automatically engages in the slots by the action of the wire spring (94), and the plate (17) is locked in specific positions.

5. Flexible propeller and uses for small vessels according to any one of the preceding claims characterized by having a device that basically consists of a tube (38) at one end of which is fitted a propulsion system according to claim 3 or 4, and at the other end is mounted a lever (39) in an articulated manner to the axis (40), and pedals (42) are mounted on the end of the lever (39) being articulated so that the bars (43) of the pedals (42) are then mechanically connected by rods or cables (44) to the lever (45) and cables (12) and (13), after passing over pulleys (15) and by the inner tube (38) and then out at the end where lever (39) is mounted, and then a pair of handles (47) are fixed to the end of cables (12) and (13) allowing the user to actuate the handles (47) alternately with hands as he supports and directs the vessel with the feet, through the pedals (42), and the device described above can be fixed on vessels at three points that determine an isosceles triangle: two points located at the ends of the plate (49) fixed at the bottom of tube (38) and a third point (50) located at the front of the tube (38), near the propulsion system.

6. Flexible propeller and uses for small vessels according to claim 5 characterized by having a base (52) similar to a traction pad which can be pasted on the deck of the board (51) and this base (52) have three inserts (53) spaced so as to determine an isosceles triangle and the inserts (53) have a fixing mechanism to enable that a device according to claim 5 can be mounted on the base (52).

7. Flexible propeller and uses for small vessels according to claim 3 or 4 characterized by having a structure composed of a main structure (55) at one end of which is fitted a propulsion system according to claim 3 or 4, and at the other end is mounted a secondary structure (56) having a tube (66) for the assembling of levers (67), which can rotate independently, and on the end of which are attached pedals (57) and is also attached to the ends of cables (12) and (13) which are connected mechanically to the shaft (8), allowing the user to push the pedals (57) with feet, thus rotating shaft (8), while the user can guide the vessel through a handlebar (71) connected mechanically to the control lever (31) and the ends of the handlebar (71) may be articulated to allow adjustment according to the height of the user and also to assume a more compact condition.

8. Flexible propeller and uses for small vessels according to claim 7 characterized by the secondary structure (56) is mounted on the main structure (55) in an articulated manner and by the presence of pin (58) which is mounted in the slot (59) present on the main structure (55) and simultaneously in the guide tube (60) which is positioned inside the tube of the main structure (55) so that the hole present in the central pin (58) is aligned with the hole present in the central part of the guide tube (60) allowing the hook end of the tension spring (61) being introduced in the hole of the guide tube (60) passing through the pin (58) hole and eliminating in this way the possibility of axial displacement between the guide tube (60) and pin (58) and the hook from the opposite end of the spring (61) is fitted in the hole present in the plate (62) which is mounted in an articulated manner on the central part of shaft (63), on which is also mounted in an articulated manner, the secondary structure (56) and two pulleys (15), and the pulleys (15) are positioned within and near the end of the tube of the main structure (55) and tension spring (61) maintains the pin (58) constantly pressed against the end of the slot (59) allowing the secondary structure (56), when rotated to the operating position, causes the plate (64) gradually triggers the pin (58) which is automatically inserted into the slot (65) present on the plate (64), keeping the secondary structure (56) locked in the operating position, and to retract the secondary structure (56), you must pull the pin (58) with the fingers toward the other end of the slot (59), until the pin (58) clears the slot (65) present on the secondary structure (56) allowing it to be rotated to be parallel to the main structure (55), assuming, thus, a reduced volume.

9. Flexible propeller and uses for small vessels according to claim 7, characterized by having a seat which consists of the bottom (76) and backrest (77) and the bottom (76) consists of a rigid rectangular base (78), which is joined to two tubes (80) each one having one end formed and drilled to be mounted on the backrest (77), which is constructed in the same way and in the backrest (77) is mounted a triangular support (81) which is embedded in the holes (82) present on the sides of the tubes of the backrest (77) and the fitting procedure consists of elastically deform the triangular support (81) which can then be fitted into the holes (82) and after fitting the triangular support (81), it returns to its original shape while remaining engaged in the backrest (77), and the seat is fixed to the main structure (55) by a pin (83) and it can be fixed in different positions to adjust according to the length of user's legs and the fixing procedure is to position the seat so that the holes (84) present at the ends of the tubes (80) are aligned with the holes (85) present on the side walls of the main structure (55) allowing the pin (83) to be inserted thus fixing the seat to the main structure (55) and the notch (86) at the tip of the triangular support (81) can then be fitted into one of the holes (87) in the upper wall of the tube of main structure (55), providing the necessary support to the backrest (77) and allowing to adjust the inclination of the backrest (77) by changing the hole (87) where the notch (86) is attached.

10. Flexible propeller and uses for small vessels according to claim 7 characterized by having four tubes (88) attached on the side of the main structure (55) allowing the fitting of four connecting rods (90) linking the main structure (55) to a pair of floats (91) arranged in a catamaran configuration.

* * * * *